US010597207B2

(12) United States Patent
Seelhofer

(10) Patent No.: US 10,597,207 B2
(45) Date of Patent: Mar. 24, 2020

(54) FILLABLE CAP CLOSURE WITH A FILM SEAL THAT IS OPENED PURELY BY MEANS OF ROTATION OR AXIAL PRESSING

(71) Applicant: Bevaswiss AG, Neuhausen am Rheinfall (CH)

(72) Inventor: Fritz Seelhofer, Lindau (CH)

(73) Assignee: BEVASWISS AG, Neuhausen am Rheinfall (CH)

( * ) Notice: Subject to any disclaimer, the term of this patent is extended or adjusted under 35 U.S.C. 154(b) by 32 days.

(21) Appl. No.: 15/761,043

(22) PCT Filed: Sep. 19, 2016

(86) PCT No.: PCT/EP2016/072167
§ 371 (c)(1),
(2) Date: Mar. 16, 2018

(87) PCT Pub. No.: WO2017/046420
PCT Pub. Date: Mar. 23, 2017

(65) Prior Publication Data

US 2018/0265268 A1 Sep. 20, 2018

(30) Foreign Application Priority Data

Sep. 18, 2015 (CH) ..... 1356/15

(51) Int. Cl.
*B65D 51/28* (2006.01)

(52) U.S. Cl.
CPC ..... *B65D 51/2821* (2013.01); *B65D 51/2835* (2013.01); *B65D 2101/0038* (2013.01); *B65D 2251/0093* (2013.01); *B65D 2251/023* (2013.01)

(58) Field of Classification Search
CPC ..... B65D 51/2821; B65D 51/2828; B65D 51/2835; B65D 2101/0038
(Continued)

(56) References Cited

U.S. PATENT DOCUMENTS 5,482,176 A * 1/1996 Maietta ..... B65D 77/067 220/277
7,971,739 B2 * 7/2011 Ammann ..... B65D 51/227 215/227

(Continued)

FOREIGN PATENT DOCUMENTS

WO 2005073098 A1 8/2005
WO 2009023976 A1 2/2009
WO 2015009171 A1 1/2015

OTHER PUBLICATIONS

International Search Report issued in connection with PCT/Ep2016/072167 dated Oct. 13, 2016.

*Primary Examiner* — Steven A. Reynolds
*Assistant Examiner* — Javier A Pagan
(74) *Attorney, Agent, or Firm* — Steven M. Shape; Dennemeyer & Associates, LLC

(57) ABSTRACT

The invention relates to a fillable twist cap closure for receiving and film-sealing a liquid or pourable filling in the interior of the closure and for emptying out the filling purely by rotating the twist cap (1). The closure consist of a receiving part (3) which is screwed onto the threaded connection of a container and which comprises a cylinder (7) that is open at the bottom, said cylinder (7) being film-sealed at the bottom, and a cup (2) that can be introduced headfirst into the cylinder (7). All plastic parts (1-3) are made of a steam-absorbing polymer, and piercing and cutting teeth (5) which extend in the axial direction are molded on the lower edge of the cup (2). Guide means (9, 10, 28) on the outside of the cup (2) interact with guide means (8, 12) on the twist cap (1). When the twist cap (1) is rotated, an axial movement of the cup (2) is first produced in order to pierce the film (33) on the receiving part (3). Upon a further rotation, a purely horizontal rotation is then produced in order to cut open the film (33) along the film
(Continued)

circumference by less than 360°. Finally, the cup (2) is moved again axially downwards in order to fold open the cut film (33), whereby the contents of the cup fall downwards.

12 Claims, 7 Drawing Sheets

(58) Field of Classification Search
USPC ..... 220/258.1, 258.3, 258.4, 265, 267, 277; 222/80, 81, 83
See application file for complete search history.

(56) References Cited

U.S. PATENT DOCUMENTS

| | | | | |
|---|---|---|---|---|
| 8,544,685 | B2 * | 10/2013 | Swanick | B65D 47/0804 222/153.07 |
| 2004/0104247 | A1 * | 6/2004 | Anderson | B65D 51/2835 222/83 |
| 2009/0050648 | A1 * | 2/2009 | Wisniewski | B65D 47/2031 222/83 |
| 2010/0230410 | A1 * | 9/2010 | Last | B65D 51/228 220/258.4 |
| 2012/0181281 | A1 * | 7/2012 | Ott | B65D 5/748 220/277 |
| 2014/0367283 | A1 * | 12/2014 | Bennett | B65D 81/3211 206/221 |

* cited by examiner

FILLABLE CAP CLOSURE WITH A FILM SEAL THAT IS OPENED PURELY BY MEANS OF ROTATION OR AXIAL PRESSING

CROSS-REFERENCE TO RELATED APPLICATIONS

This is a 35 U.S.C. 371 National Stage Patent Application of International Application No. PCT/EP2016/072167, filed Sep. 19, 2016, which claims priority to Swiss application 01356/15, filed Sep. 18, 2015, each of which is hereby incorporated by reference in its entirety.

The invention relates to a fillable cap closure which is sealed at the bottom with a film, wherein the content is emptied into the container, with which the closure is provided, by rotating the cap of the closure, on the one hand, or by purely axially pressing the cap.

Many beverages are already produced by mixing a concentrate with water nowadays. Instead of distributing the finished mixture, it would be much more efficient if the bottle fillers could simply fill water locally, and the concentrate were only added to the water in the bottle and then mixed with it by means of the initial opening of the bottle by the consumer. All kinds of sensitive active ingredients and light-sensitive vitamins can also be metered by means of such a closure.

A known solution for metering a separate liquid is a plastic metering closure and an associated container neck for a container as indicated in WO2012/175317 A1. This is a fillable closure comprising a push-button for release, which functions with a separately filled capsule. The closure consists of a closure cap which can be screwed onto the threaded connection piece of a container and into which the separately filled capsule can be inserted from below in the closed state, the capsule having a downwardly directed sealing film. The upper side of the inserted capsule is designed to be deformable and can be pressed axially downwards so that the downwardly directed sealing film of the capsule can be broken or caused to split. According to this document, this is brought about by means of a profile which is integrally formed on the underside of the closure cap and projects axially downwards, and which fits into a depression that is disposed in the deformable upper side of the inserted capsule and matches the cross-section of this profile. By pressing down the profile into the depression, the outer lower corners of the profile are pressed onto the sealing film of the capsule. The sealing film is provided with weakening lines so that these corners impinge on the angle bisectors of the circle segments formed by the weakening lines, and the same can be pivoted downwards from the corners after the weakening lines split and can then be held pivoted downwards. In practice, however, it has been found that although this solution works in principle, it does not work properly in every case, i.e. not in 100% of cases. Therefore, this solution is insufficiently suitable for implementation in practice in which hundreds of thousands of closures have to be delivered and each individual closure has to function perfectly.

The object of the present invention is therefore to provide a fillable cap closure comprising the film sealing of contents, the filled contents of which fall into the container provided with the closure either by means of rotating the cap, by cutting open and folding down the film, or the emptying of which can be triggered purely by axially pressing the cap. This fillable closure is intended to be even simpler to produce and assemble, consist of a minimal number of parts, and only be operated by means of a single action, namely either by rotating the cap or by axially pressing the cap in such a way that the film is cleanly cut open and then folded down such that its content or filling fall totally safely and reliably into the container provided with the closure. The closure is intended specifically to ensure that the film being once folded down cannot be pivoted halfway closed again. In addition, the filling in the closure should be protected against oxygen, UV radiation and water vapor entering from the surroundings.

This object is achieved by a fillable cap closure for receiving and film-sealing a liquid or pourable filling in the interior thereof and for emptying purely by rotating the cap or purely by axially pressing the cap, consisting of a receiving part which can be screwed onto the threaded connection piece of a container and has a cylinder which is open at the bottom, wherein the cylinder is film-sealed at the bottom, and a cup which can be inserted headfirst into the cylinder, comprising at its edge at least one piercing and cutting tooth which extends over the edge in the axial direction, and guide means on the outer side of the cup, and a twist cap having drivers engaging in the guide means on the cup for the axial displacement of the cup downwards in order to pierce the film, then to horizontally rotate the cup thereby cutting the film open in the process along its circumference by less than 360°, and then to axially displace the cup downwards again in order to fold down the cut-out film.

The film is thus pierced precisely and reliably at its periphery, and the film once pierced is then cut open along its circumference by approximately 360°, and in a third step, the film is folded down by approximately 90° over the film edge which is left and not cut open, and releases the cup such that the contents thereof fall completely and reliably downwards into the container provided with the closure, irrespective of whether the cup contents are liquid or solid. Furthermore, the laminate structure of the film ensures impermeability against the penetration of oxygen, water vapor or UV radiation.

The figures show the fillable cap closure and its individual components in different views, specifically an embodiment which can be emptied by means of purely rotating, and an embodiment which can be emptied by means of purely axially pressing the cap. The various embodiments of this cap closure are described in detail and their functions are explained on the basis of these figures.

Figure 1:
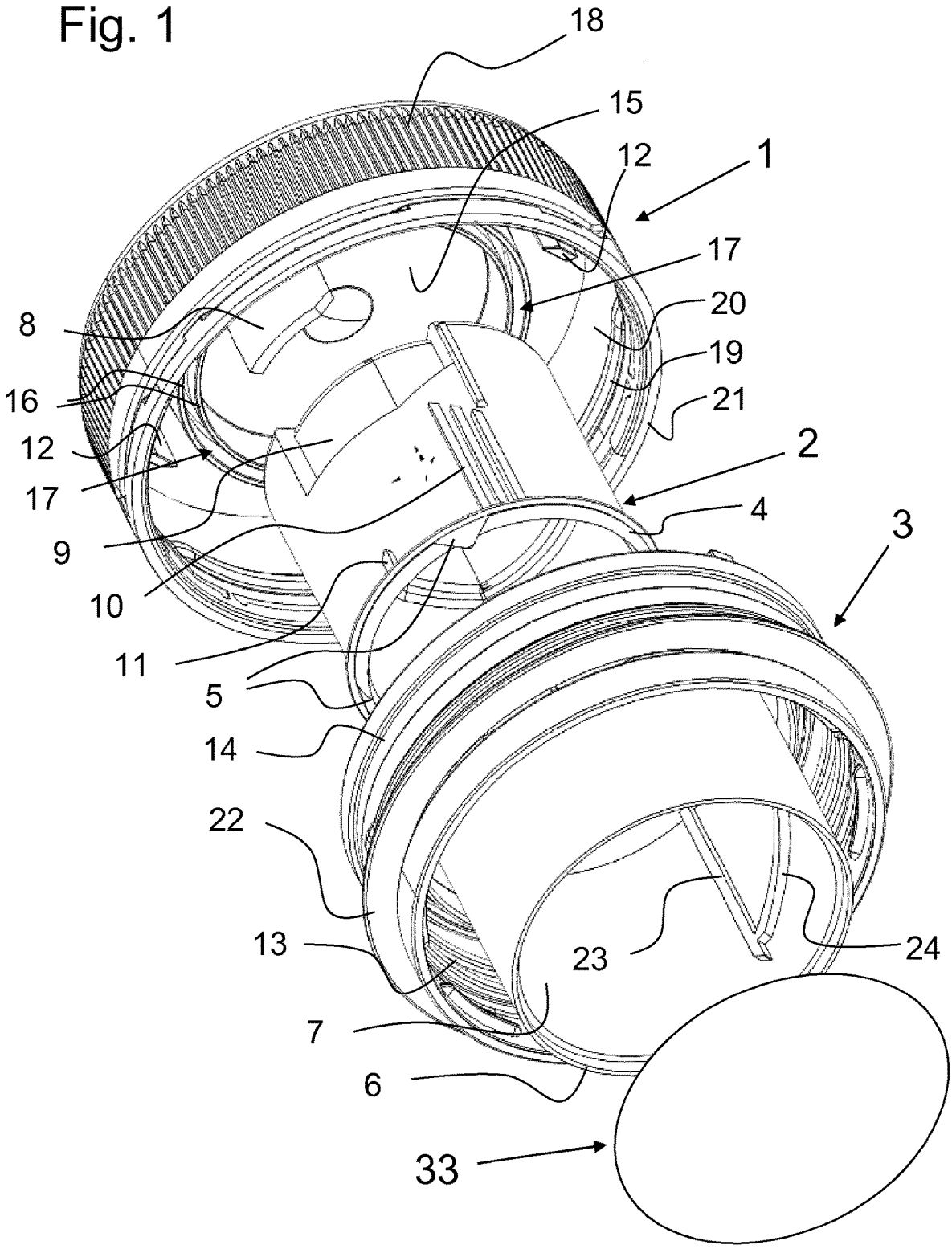
FIG. 1: The three plastic components are shown in an axial exploded view, and below them the film for sealing.

In a first embodiment, this cap closure consists of a total of four parts, of which the plastic parts 1, 2 and 3 are shown in FIG. 1, specifically in a view in which the three plastic parts are shown at a distance from one another along their common axis of rotation. The fourth part is the laminate film, by means of which the lowermost visible edge of the cylinder there can be closed.

Proceeding from the top, the cap closure, configured here as a twist cap closure, consists of the twist cap 1, then, under same, a fillable cup 2 and finally, at the very bottom, a receiving part 3, into which the cup 2 can be inserted. When the cup 2 is inserted into the receiving part 3, the piercing and cutting teeth 5, which are integrally formed below the cup on the edge 4 thereof and project downwards beyond same, do not extend all the way to the lower edge 6 of the cylinder 7 in the interior of the receiving part 3. At the upper end, this cylinder 7 is connected to the outer region of the receiving part 3, as is again clear on the basis of further representations. In the interior of the twist cap 1, on the lid of the twist cap, axially downwardly projecting drivers 8 can be seen, which are intended to interact with guide means on the cup 2. These are formed, firstly, from two mutually facing depressions 9 on the outer side of the cup 2, and, secondly, the axially extending ribs 10 on the outer side of the cup 2, and, thirdly, the push rods 11 on the upper side of the edge 4 of the cup 2, the edge being at the bottom and projecting outwards. On the inner side of the twist cap 1, the stopper 12 can also be seen for rotating the receiving part 3, by means of its internal thread 13, onto the threaded connection piece of a container. Furthermore, on the inner side of the twist cap 1, on the underside of the cap lid 15, a groove 17 formed by two concentric tube sections 16 can be seen, which fits over the upper end of the cylinder 7 in the receiving part 3. The twist cap 1 is provided with a ribbing 18 on the outside so that it can be rotated firmly by hand without the hand slipping. A ring 21, which is held via fine material bridges, is integrally formed on the lower edge of the twist cap 1 as a tamper-proof guarantee. The receiving part 3 has a circumferential projecting ring 14 on the outside, can be placed over the two mutually facing bead sections 19 on the inner side of the twist cap wall 20 and then close below the ring 14 for retaining the twist cap 1 on the receiving part 3 and for ensuring that the twist cap 1 can rotate on the receiving part 3. A projecting circular ring 22 can be seen on the receiving part 3, which rests on a container connection piece on the upper edge thereof after the receiving part 3 has been unscrewed. Guide ribs 23, 24 can be seen on the inside in the cylinder 7 of the receiving part 3, the guide ribs interacting with the ribs 10 on the cup, as further explained below.

The film 33 to be welded or adhesively bonded onto the cylinder 7 consists of a laminate, comprising a carrier material of at least 0.2 mm thickness, then a barrier film thereon outwards with respect to the cup, the barrier film being in the form of an oxygen barrier, water vapor barrier and UV radiation barrier, and a sealing layer in the form of a lacquer or a PE laminate layer is sprayed or laminated onto the barrier. So that the cup 2 is also impermeable to water vapor or the content is protected against water vapor penetrating from the outside, there are different ways in which same can be designed and configured. In a first embodiment, the cup 2 can be injection molded with a special plastic which contains a silica gel that is admixed in the polymer to be injection molded. This is known as an Advanced Desiccant Polymer. Using such polymers, the benefits of traditional polymers can be combined with the benefits of silica gel for moisture protection so that any molds and packaging can be injection molded with plastic, and these behave in a moisture-absorbing manner. A second embodiment consists in separately injection molding the insert for the interior of the cup from such an Advanced Desiccant Polymer, which is inserted into the interior of the cup. This insert has to have a wall thickness of 0.8 mm in order to ensure sufficient water vapor absorption. In a third embodiment, a water vapor barrier is formed by spraying an EVOH layer (EVOH=ethylene-vinyl alcohol copolymer) onto the inner sides of the cup to protect the contents from water vapor. In a fourth embodiment, the cup can be produced in a conjective method, in which an EVOH component is injected into the center of the still soft layer between an injected cavity in the injection molding tool such that the EVOH bonds with the remaining plastic in contact on both sides.

Figure 2:
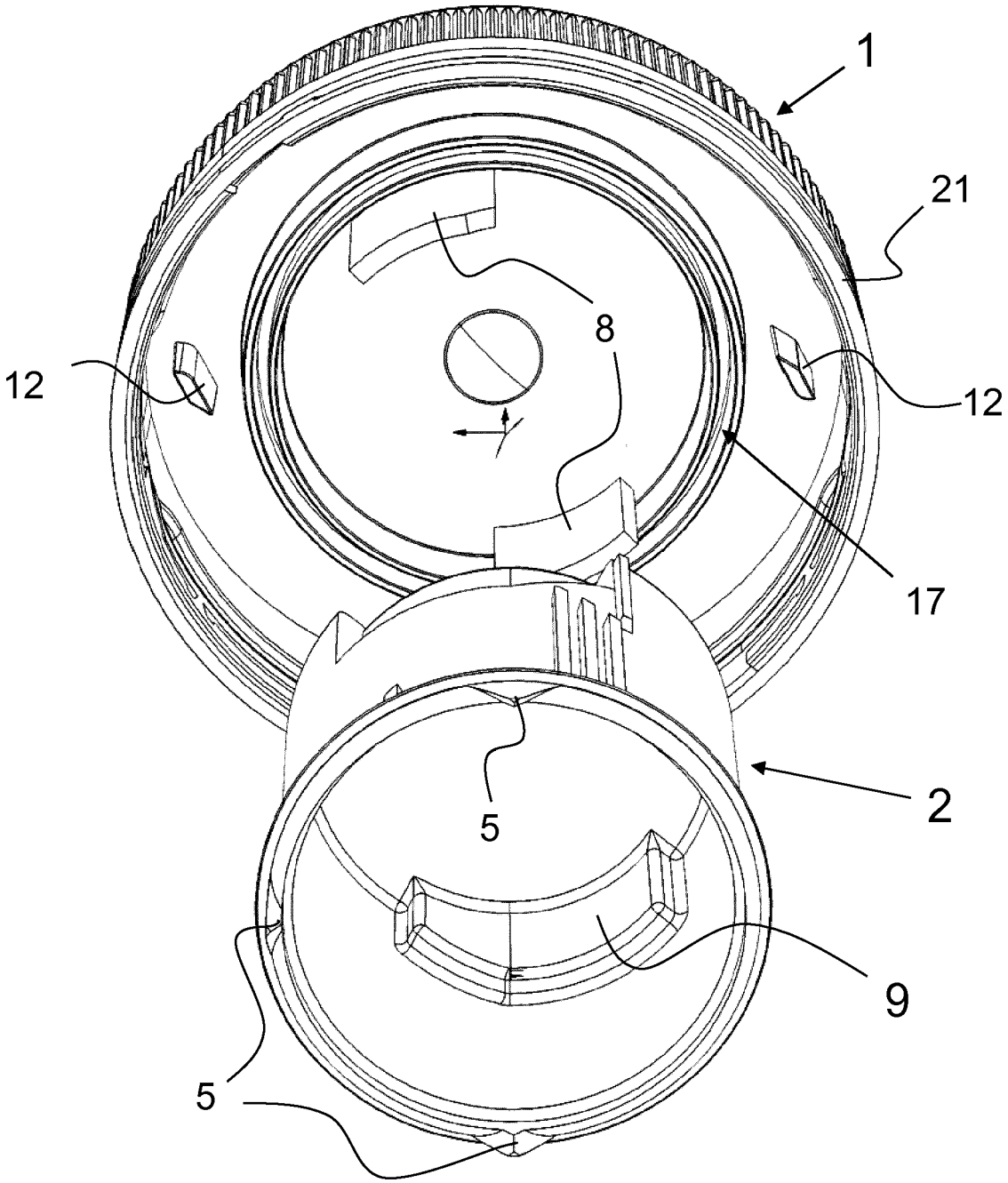
FIG. 2: The cap closure is designed as a twist cap closure, with the associated separately fillable cup, as viewed obliquely from below.

FIG. 2 shows the twist cap 1 and the cup 2 in a view from approximately below. In this view, the formation of the two drivers 8 in the interior of the twist cap 1 can be seen as well as the groove 17 and the two stoppers 12, the function of which is further explained. The inner side, as produced by the depressions 9 visible from the outside, can be seen on the cup 2. In the example shown, the lower edge of the cup 2 is provided with three piercing and cutting teeth 5, which project downwards in the axial direction. Two piercing and cutting teeth 5 are arranged opposite one another and displaced by 180° with respect to one another, and a third piercing and cutting tooth 5 lies on the edge at a mean distance from the two others. If, in the case of left rotation of the twist cap 1 (i.e. clockwise in the view shown here) the cup 2 is rotated (in the counterclockwise direction as viewed from above), the cutting teeth 5 cut arcuate cuts along the cup circumference, and when rotation of the cup 2 takes place by slightly less than 180°, a remainder of film of the otherwise intersected circumference remains intact.

Figure 3:
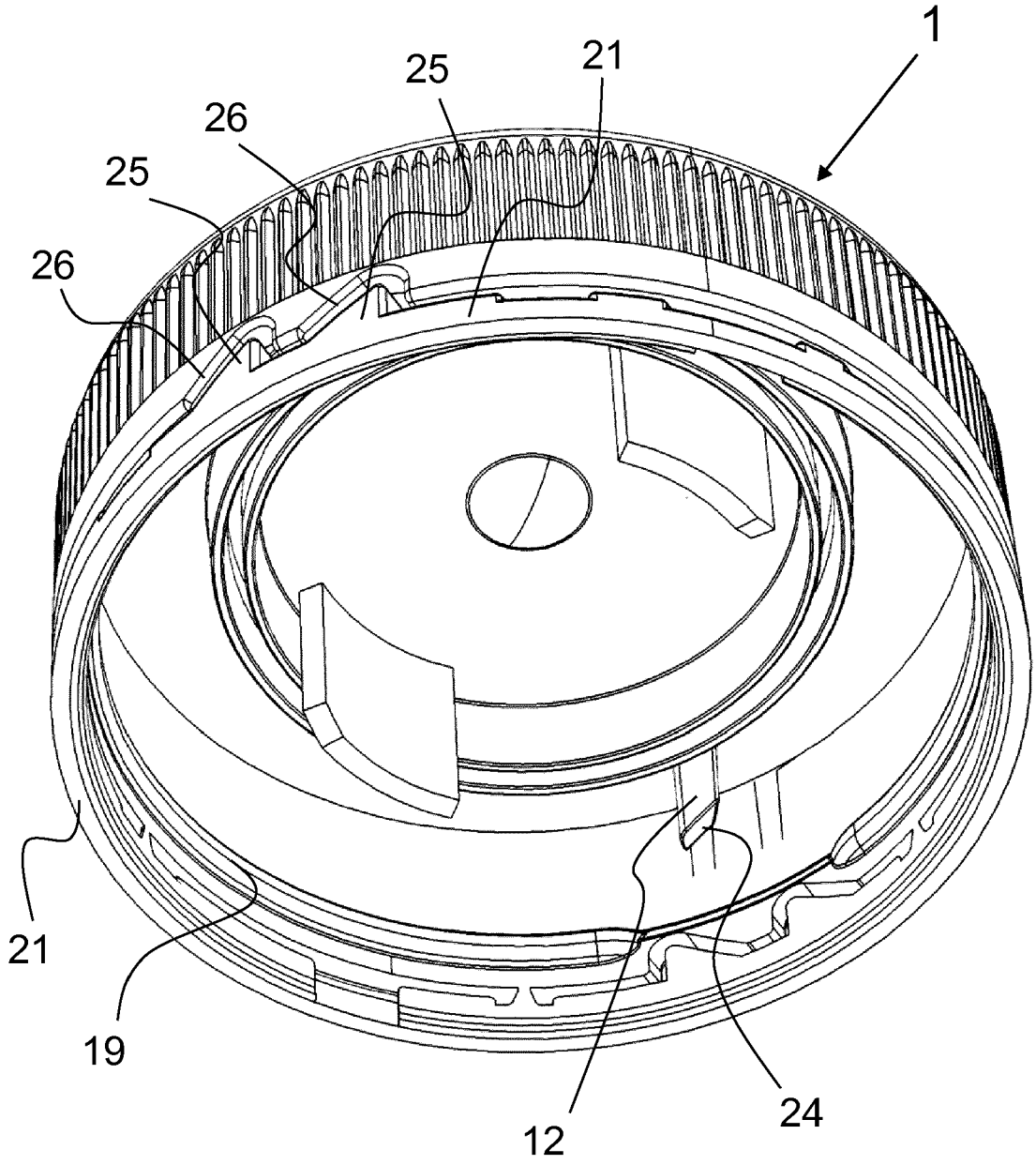
FIG. 3: The twist cap according to FIG. 2, with its drivers, as viewed obliquely from below.

FIG. 3 shows the ring 21 for tamper-proof guarantee, on which wedges 25 project upwards and fit into wedge-like recesses 26 on the lower edge of the outer wall of the twist cap 1. If the twist cap 1 is rotated for the first time to the left, i.e. as viewed from above in the release direction, namely in the counterclockwise direction, the recesses 26 slide with their lower edges onto the wedges 25 and a force is produced upwards until the material bridges holding the ring 21 on the twist cap 1 break. The twist cap 1 can then be further rotated on the receiving part 3. This rotation then brings about a specific interaction with the cup 2 so that the latter is initially axially lowered to some extent, then rotated and then slightly axially lowered again.

Figure 4:
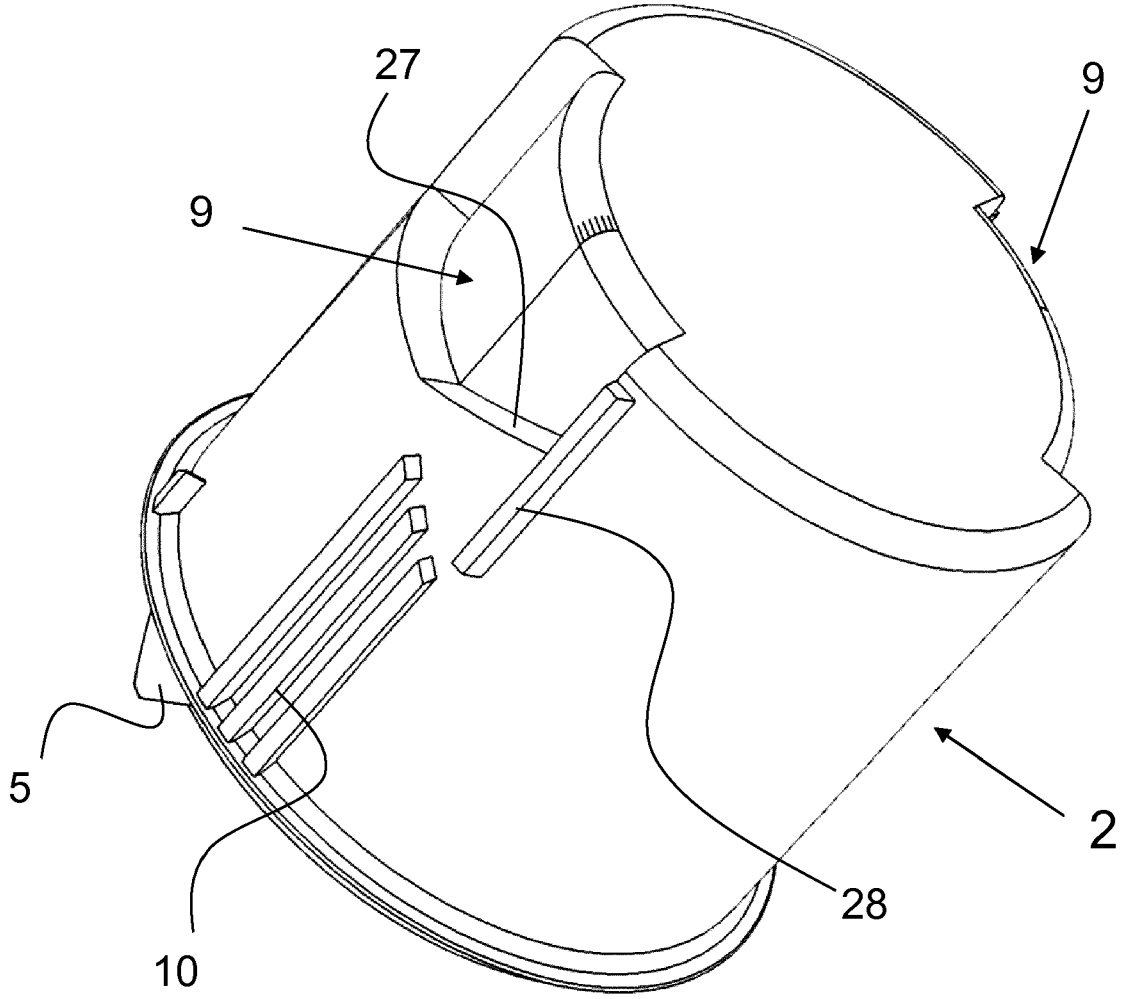
FIG. 4: The fillable cup with its guide means for the drivers, as viewed obliquely from above.

FIG. 4 shows the cup 2 with its special design. Two mutually facing depressions 9 can be seen on its upper outer wall, which at the bottom form an oblique surface 27 on which the drivers 8 on the twist cap 1 act. If these are rotated in the counterclockwise direction, they press the cup 2 downwards in the axial direction when driving onto the oblique surfaces 27 because the twist cap 1 is held on the receiving part 3 along the ribs 28 and thus cannot rotate. This pressing down of the cup 2 results in the piercing and cutting teeth 5 at the lower edge of the cup piercing the film which spans the lower edge of the cylinder 7 in the receiving part 3. Further rotation of the twist cap 1 leads to the drivers 8 rotating the cup 2 in the counterclockwise direction because the ribs 28 have been lowered below the stoppers 12. As a result, the cup 2 executes pure rotation, and likewise the cutting teeth 5. The cutting edges cut a circumferential slit in same for approximately 360° on the outer periphery of the film so that it is held on the outside only on a narrow film material bridge. The ribs 10 on the outer wall of the cup 2 hold the latter at a distance from the inner wall of the cylinder 7 in the receiving part 3 and are used so that after the film has been cut open, the cup 2 executes its third movement, namely an axial downward movement once again, by means of which the cut-out film disk is folded downwards.

Figure 5:
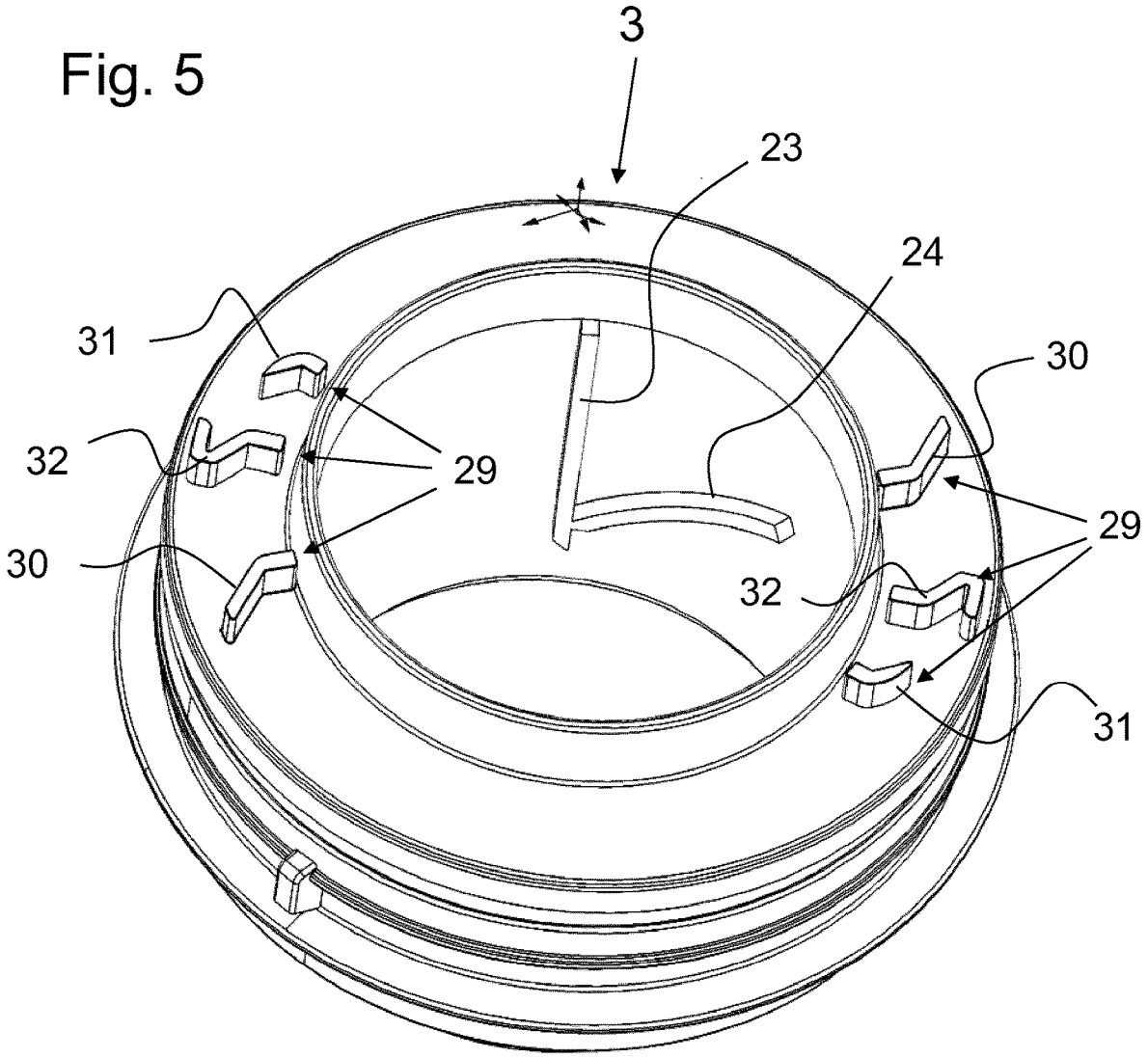
FIG. 5: The receiving part which can be screwed onto a container, as viewed obliquely from above.

FIG. 5 shows the receiving part 3 from above. The guide means 23, 24 on two opposite sides of the inner wall of the cylinder 7 are designed such that the upper ends of the ribs 10 on the cup 2 move under the guide ribs 24 in the final phase of the rotation of the cup 2 and, during further rotation, slide along these guide ribs 24, and thus the cup 2 is pushed axially downwards to some extent. In the process, its lower edge folds the cut-out film disk downwards by approximately 90°. The stop elements 29 on the upper side of the receiving part 3 are used so that the twist cap 1 by means of its stoppers 12 interacts with the stop elements 29 so that, firstly, the entire twist cap closure can be screwed with its receiving part in the clockwise direction onto a container connection piece, and can then be rotated in the counterclockwise direction relative to the receiving part 3, without detaching the latter from the container neck again, in that the stoppers 12 slide over the oblique surfaces 30 and after almost 180° of rotation over the oblique surfaces 31 enter into the catchers 32 and stop the left rotation in order to enable complete unscrewing of the twist cap closure from the container.

Figure 6:
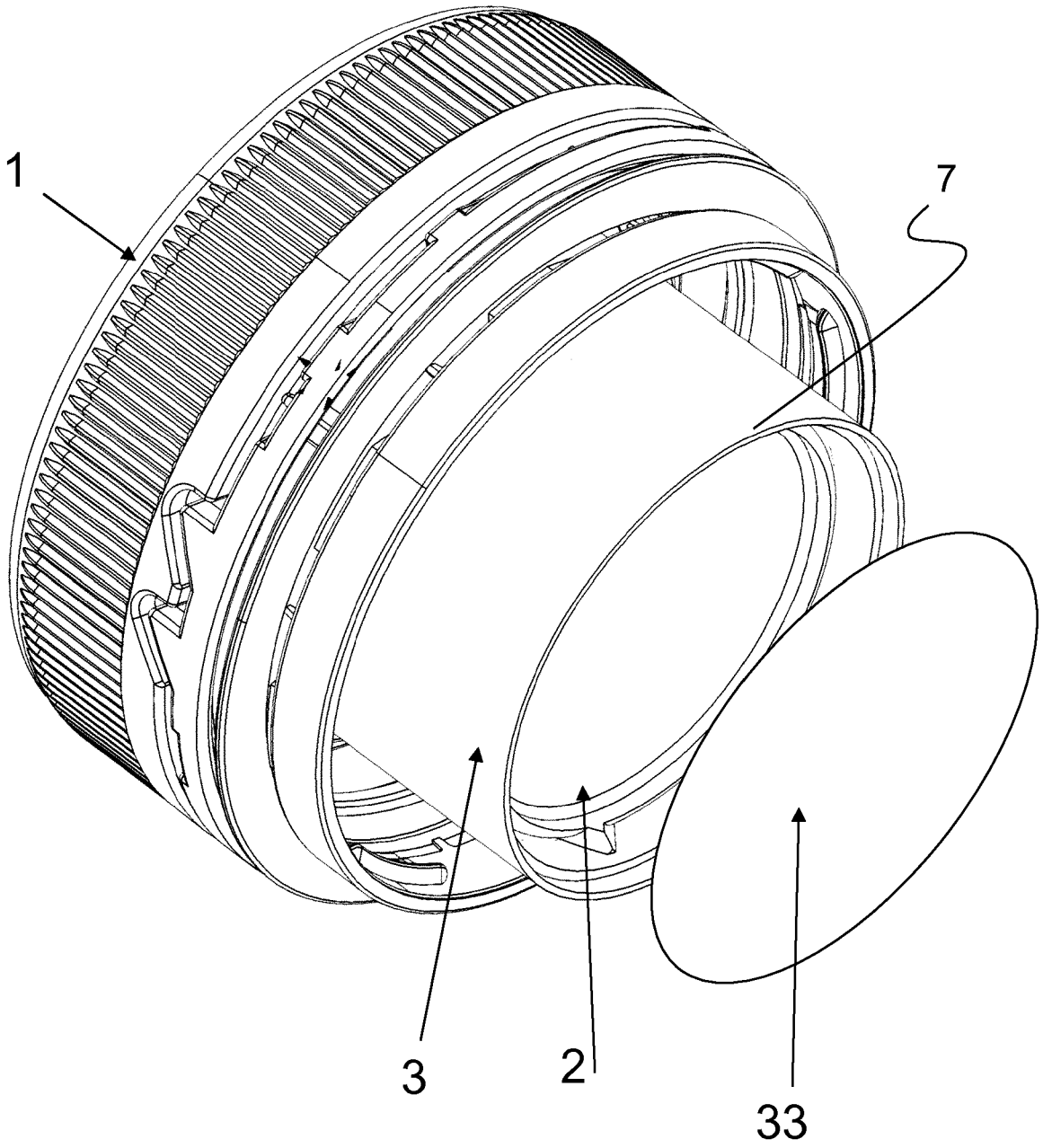
FIG. 6: The complete twist cap closure according to FIG. 2 in the assembled state, with the laminate film to be sealed onto the cylinder edge.

The assembled twist cap closure is shown in FIG. 6. In this assembled state, it is brought into an inverted position, and is directed upwards with the open cylinder 7. It can be filled in this position, either with a liquid or a pourable or free-flowing filling material. Finally, a laminate film 33 is adhesively bonded or welded onto the edge of the cylinder 7. The twist cap closure is then ready to be screwed onto a container connection piece. During the subsequent rotation of the twist cap 1 to the left, the film 33 is first pierced by means of a purely axial downward movement of the cup 2, then the film 33 is cut open by means of purely rotating the cup 2, and finally the film disk is folded downwards by once again purely axially pressing down the cup 2.

Figure 7:
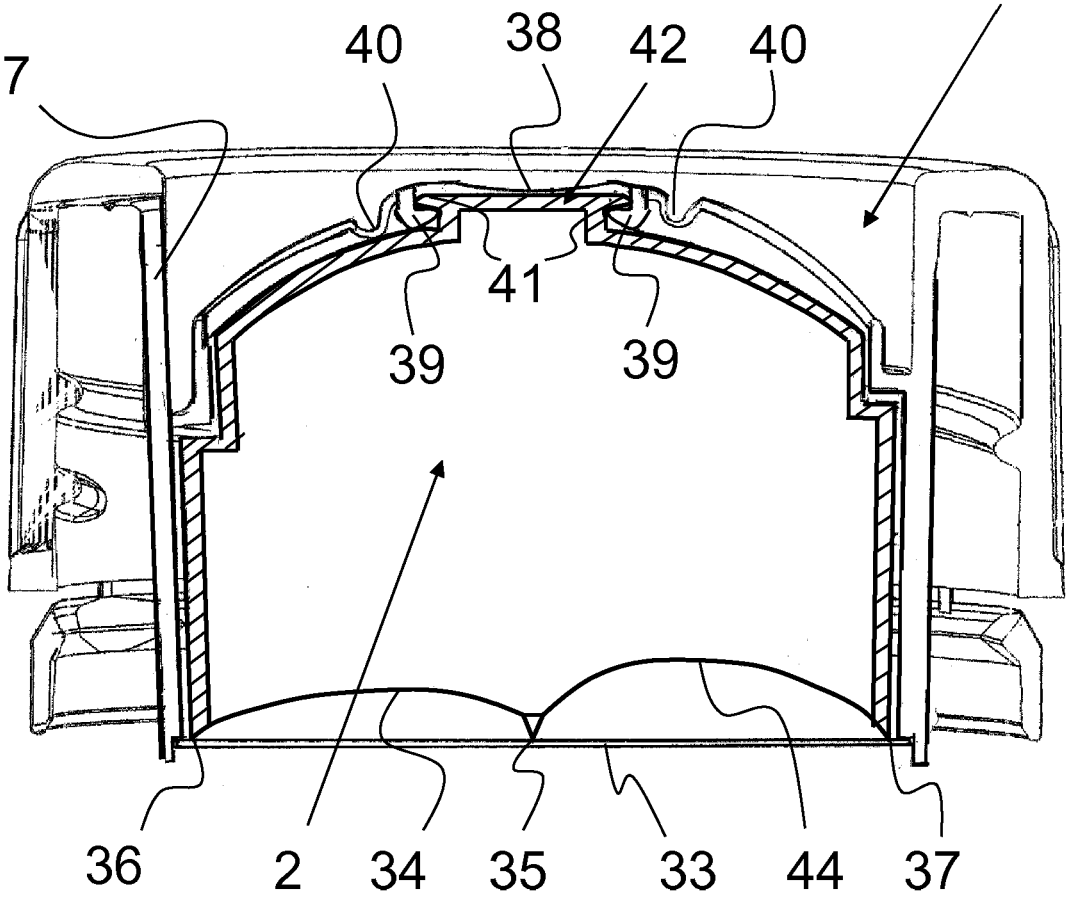
FIG. 7: An embodiment of the cap closure for triggering emptying by means of purely axially pressing the cap.

FIG. 7 shows an alternative embodiment of the cap closure, to which solely pressure acting axially on the cap lid can be applied to cause the cup contents to fall down. The cap lid only needs to be pressed with a finger or thumb. For this purpose, the cap closure, in an inverted position, forms a receiving container or a receiving part 3, into which a cup 2 can be inserted. The cup 2 is shaped in a particular manner. At its upper end, in the image, or at the center of its base, on its outer side, it forms an outwardly projecting short tube section, the end of which is closed by means of a lid 42 having a slightly projecting edge 41. On its upper side, this edge slopes downwards and obliquely towards the outside, and the downwards sloping ring formed in this way forms a sliding surface 43. The counterpart to this circumferential and slightly projecting edge 41 lies in a plurality of resilient hooks 39 arranged in a distributed manner around the circumference of the tube section, the hooks being integrally formed on the underside of the receiving part 3 formed by the cap. If the cup 2 is inserted into the receiving part from below as in the image shown, the circumferential edge 41 initially adjoins the hooks 39. If pressure is applied, its bevelled sliding surface 43 slides over the oblique surfaces projecting downwards on the hooks 39 and these pivot radially outwards so as to slide away under pressure and under the bevelled edge. As a result, the projecting edge 41 of the lid 42 of the tube section passes these hooks 39 and snaps in behind the hooks 39, which again pivot back flexibly towards the center of the cap for this purpose. In the end, however, the cup 2 is reliably held in the receiving part 3. The receiving e part is formed in a flexible manner in the upper region in the image as a result of its thinner wall thickness. In the center, it forms a pusher surface 38, having a circumferential groove-like depression, a notch 40, which makes it possible for the pusher surface 38 to be pressed downwards in the axial direction by deforming the notch 40. The receiving part 3 is closed at the bottom by a sealing film. The film 33 to be welded or adhesively bonded onto the lower edge of the receiving part 3 consists of a laminate, comprising a carrier material of at least 0.2 mm thickness, then a barrier film thereon outwards with respect to the cup, the barrier film being in the form of an oxygen barrier, water vapor barrier and UV radiation barrier, and a sealing layer in the form of a lacquer or a PE laminate layer being sprayed or laminated, as already described in detail above, onto the barrier film. The same also applies to the cup 2 and its characteristics, which is also described in detail above. It has to have a wall thickness of at least 0.8 mm in order to ensure sufficient water vapor absorption. In the example shown, the cup has a capacity of 2 ml, which is sufficient for numerous applications.

As a special feature, the cup 2 is formed with its lower edge in such a manner that same forms three downwardly projecting piercing tips 35. The edge between the piercing tips is in the form of three arcs 34, each having a downwardly projecting sharp edge. When the cup 2 is pressed down in a purely axial manner in the interior of the receiving part 3, by virtue of the fact that the dome thereof is pressed down with the pusher surface 38, the three piercing tips arranged in a distributed manner over the circumference pierce the film 33 at three points, and, when pushed down further, the arcs 34 with their sharp edges act as blades. The one arc is cut out higher so that when the cup 2 is pressed down, the film is cut open along its circumference only by about 340°, and thus approximately by 360°. In addition, the higher cut-out arc is produced with a blunt edge at its center over about 20°. If the cup 2 is pressed further downwards, the cut-out film disk 33 is pivoted downwards about the material bridge left and the entire contents of the cup 2 fall into the container provided with the closure. The cap closure can now be unscrewed from the container connection piece and the ready-prepared and mixed beverage is available for drinking.

LIST OF REFERENCE SIGNS

1 Twist cap
2 Cup
3 Receiving part
4 Projecting edge at the bottom of the cup 2
5 Piercing and cutting tooth
6 Lower edge of open cylinder on the receiving container 3
7 Cylinder
8 Drivers on the twist cap 1
9 Depressions on the cup
10 Axial ribs on the cup
11 Push rods on the cup 2
12 Stopper on the twist cap 1
13 Internal thread on the receiving part 1
14 Annular bead on the outside of the receiving part 1, for holding the twist cap 1
15 Cap lid of the twist cap 1
16 Tube sections for groove 17
17 Groove
18 Ribbing on the twist cap 1
19 Bead on the twist cap 1
20 Wall of twist cap 1
21 Ring on the twist cap 1 for tamper-proof guarantee

22 Circumferential circular ring on 3
23 Guide rib
24 Guide rib for final axial displacement of the cup 2
25 Wedges on the ring 21
26 Recess on wall of twist cap 1
27 Oblique surface in recess on cup 2
28 Rib on outer side of cup 2
29 Stop elements on top of receiving part 3
30 Oblique surface on stop element
31 Oblique surface
32 Catcher
33 Film
34 Arc with sharp cutting edge
35 Piercing tooth in the embodiment according to FIG. 7
36 Second piercing tooth in the embodiment according to FIG. 7
37 Third piercing tooth in the embodiment according to FIG. 7
38 Pusher surface on the cap lid in the embodiment according to FIG. 7
39 Hook which can be flexibly and radially pivoted away, in the embodiment according to FIG. 7
40 Groove for allowing the pusher surface to be pushed down in the cap lid in the embodiment according to FIG. 7
41 Projecting edge of tube section on the outside of the cup base, having a bevelled edge on the outside in the form of a sliding surface
42 Lid surface of tube section on the cup base
43 Bevelled sliding surface on the outside of the edge 41 of the lid 42

The invention claimed is:

1. A fillable cap closure for receiving and film-sealing a liquid or pourable filling in an interior cavity of a container and for emptying by purely rotating a twist cap (1), the fillable cap closure comprising:

a receiving part (3) is screwed onto a threaded connection piece of the container, the receiving part having a cylinder (7) which is open at a bottom of the cylinder, wherein the cylinder (7) is sealed by a film at the bottom; and a cup (2) which is inserted into the cylinder (7), the cup comprising at an edge of the cup at least one piercing and cutting tooth (5) which extends over the edge in an axial direction, and a plurality of guide means in the form of two depressions (9) which are opposite one another on an outer wall of the cup (2) and initially opposite a base of the cup, the two depressions each forming an oblique surface (27) on an end facing away from the base of the cup, wherein the twist cap (1) is provided with drivers (8) which engage in the depressions (9) on the cup (2) to open and pivot down the film by rotating the twist cap, wherein a first rotation the drivers (8) can drive onto each oblique surface (27) and an axial displacement of the cup (2) downwards is brought about to pierce through the film (33), then by further horizontally rotating the twist cap (1), in that the drivers (8) rotate the cup by abutting lateral surfaces of the depressions (9), the film (33) is cut open along a circumference thereof by less than 360°, and by subsequently further rotating the twist cap, another axial displacement of the cup (2) downwards to fold down the film (33) is brought about by ribs (10) that extend axially on the outer wall of the cup (2) moving down a guide rib (24) that extends at an oblique angle on an inner wall of the cylinder (7).

2. The fillable cap closure wherein the drivers (8) engage the guide means (9) on the cup (2) for the axial displacement of the cup (2) downwards in order to pierce the film (33), such that horizontally rotating the cup (2) cuts the film (33) open along the circumference thereof by less than 360°, and displacement of the cup (2) again downwards folds down the cut film (33).

3. The fillable twist cap closure according to claim 1, wherein the edge of the cup (2) has three piercing and cutting teeth (5), of which two teeth are opposite one another and a third tooth is integrally formed on the edge between the two opposite teeth, such that a rotation of the cup (2) by 180° cuts open the film (33) by 360°.

4. The fillable twist cap closure according to claim 1, wherein the cup (2) includes a polymer having a water-vapor absorbent component.

5. The fillable twist cap closure according to claim 1, wherein the cup (2) comprises an insert which is separately formed of a water-vapor repellent polymer and has a wall thickness of at least 0.8 millimeters, the insert being insertable into an inside of the cup to act in a water-vapor absorbing manner.

6. The fillable twist cap closure according to claim 1, wherein the cup (2) comprises a water vapor barrier having a layer including an ethylene-vinyl alcohol copolymer on an inner surface of the cup (2).

7. The fillable twist cap closure according to claim 1, wherein the cup (2) has an inner surface including an ethylene-vinyl alcohol copolymer component, which is connected on both sides to a wall material.

8. The fillable twist cap closure according to claim 1, further comprising:

a stopper (12) integrally formed on the twist cap, the stopper projecting outwards and downwards on an inner side of a lid of the twist cap to delimit the rotation of the twist cap (1); and at least one rib (28, 10) integrally formed on the outer wall of the cup (2) for further axially pressing down the cup (2) in the receiving part (3).

9. The fillable cap closure according claim 1, wherein the film (33) is a laminate film comprising a carrier material of at least 0.2 millimeter thickness, and a barrier film thereon outwards with respect to the cup (2), the barrier film being in the form of an oxygen barrier, a water vapor barrier and an ultraviolet radiation barrier, and a sealing layer in the form of a lacquer or a polyethylene laminate layer on the barrier film.

10. The fillable cap closure according to claim 1, further comprising a plurality of guide ribs (24) extending at an oblique angle to an axis of the fillable cap closure, the plurality of ribs integrally formed on the inner wall of the cylinder (7) in the receiving part (3), wherein upper ends of the ribs (10) on the cup (2) in a final phase of the rotation of the cup (2) move under the plurality of guide ribs (24) and, during further rotation, slide along the plurality of guide ribs (24), and thus the cup (2) is pushed axially downwards while the film is folded down.

11. The fillable cap closure according to claim 1, wherein the twist cap (1), the cup (2) and the receiving part (3) are made of a water-vapor impermeable polymer.

12. A fillable cap closure for receiving and film-sealing a liquid or pourable filling in an interior cavity of a container and for emptying by purely rotating or purely axially pressing down a twist cap (1), the fillable cap closure comprising:

a receiving part (3) which is screwed onto a threaded connection piece of the container, the receiving part having a cylinder (7) which is open at a bottom of the cylinder, wherein the cylinder (7) is sealed by a film at the bottom; and a cup (2) which is inserted into the cylinder (7), the cup comprising at an edge of the cup at least one piercing and cutting tooth (5, 35) which extends over the edge in an axial direction, wherein on the receiving part (3) there is a pusher surface (38), into which the cup (2) is clicked with a projecting edge on a tube extension on an outer cup base of the cup (2), wherein the edge of the cup (2) has three piercing teeth (35, 36, 37) arranged in a distributed manner around a circumference thereof, between which a lower edge thereof is cut out in an arcuate manner, having sharp edges in the form of a plurality of arcs (34), and a first arc of the plurality of arcs is cut out higher than a second arc and a third arc of the plurality of arcs and has a blunt region so that a film (33) is cut out by 340° by axially pressing down the cup (2) and the second arc and the third arc cut out the film by 340° after the piercing by the three piercing and cutting teeth (35, 36, 37), wherein the blunt region of the first arc forms a material bridge, about which the film (33) is pivoted down into the container.

* * * * *